United States Patent [19]

Stein et al.

[11] 4,022,391

[45] May 10, 1977

[54] SPOOLING MACHINE SYSTEM AND METHOD TO WIND MULTI-LAYER SPOOLS, PARTICULARLY FOR WIRE, TAPE AND THE LIKE

[75] Inventors: Rudolf Stein, Neuleiningen; Werner Schmitt, Grunstadt, both of Germany

[73] Assignee: Drahtwarenfabrik Drahtzug Stein KG, Drahtzug near Grunstadt, Germany

[22] Filed: Mar. 3, 1975

[21] Appl. No.: 554,748

[30] Foreign Application Priority Data

Mar. 13, 1974 Switzerland ..... 3523/74
Mar. 13, 1974 Switzerland ..... 3522/74

[52] U.S. Cl. ..... 242/25 R; 242/7.15; 242/158 R; 242/158.4 R

[51] Int. Cl.[2] ..... B65H 54/28

[58] Field of Search ..... 242/25 R, 158 R, 158.2, 242/158.4 R, 7.14, 7.15, 7.16, 25, 158, 158.4

[56] References Cited

UNITED STATES PATENTS

| | | | |
|---|---|---|---|
| 2,845,229 | 7/1958 | Bliss | 242/25 R |
| 2,900,145 | 8/1959 | Hanson | 242/158.2 |
| 3,031,153 | 4/1962 | Attwood et al. | 242/158 R |
| 3,039,707 | 6/1962 | Beck et al. | 242/158.2 X |
| 3,544,035 | 12/1970 | Woolever | 242/158 R |

FOREIGN PATENTS OR APPLICATIONS

| | | | |
|---|---|---|---|
| 935,084 | 8/1963 | United Kingdom | 242/158 R |

*Primary Examiner*—Stanley N. Gilreath
*Attorney, Agent, or Firm*—Flynn & Frishauf

[57] ABSTRACT

To provide properly layered windings on a rotating spool, for example on a flanged spool carrier, the material is guided towards the spool at a predetermined angle of attitude, so that the windings on the spool body fall adjacent each other; the traverse of the spool with respect to the material supply position is so controlled, by means of an electronic control system, considering the width of the spool, the thickness of the material and winding speed, that the material will be wound on the spool pressed against the next previously applied winding and, at the end layers, the relative traverse speed (for example by axial shift of the winding spindle) is so controlled that, just before and after the formation of superimposed windings, the attitude angle of the supplied material will tend to become zero and then, after formation of a new winding layer, the attitude angle will reach the predetermined value.

31 Claims, 3 Drawing Figures

SPOOLING MACHINE SYSTEM AND METHOD TO WIND MULTI-LAYER SPOOLS, PARTICULARLY FOR WIRE, TAPE AND THE LIKE

The present invention relates to a system to spool elongated material on a spool carrier which is being rotated on a spindle, and more particularly to spool wire or tape-like material having circular, elliptical or polygonal cross section in superimposed windings on a flanged spooling body, and to a method which will result in neatly layered windings on the spooling body.

Many production steps require spooling or winding. Various types of material which have a very great length with respect to their cross section, typically width or thickness, are best stored in form of a spool. This is the cheapest and simplest way to store a substantial quantity of material in a small space.

Many spooling operations utilize a layer-wound spooling body, on which the material is not only superimposed, but also placed next to each other. The term "traverse" or "traverse spread" has been used to indicate the type of winding in which a plurality of wraps around a spooling form are placed next to each other, and then a new layer of similarly spooled wraps are placed thereover. Any one layer of the spooled material thus includes a plurality of windings or wraps about the spool. To permit easy removal of the material, to prevent tangling, and other difficulties, and for most efficient utilization of space, material having circular or elliptic (or other) cross section is preferably so placed on the spool that the material, at any position, is placed next to previously spooled material without any gap or space therebetween. The traverse of the feed of the material to the spool must then be matched to the material in such a way that, for each revolution of the spooling spindle, a relative motion by one material width is effected between the feed position of the material, for example wire, and the spooling spindle. Frequently the spindle is moved axially, although the feed position may move in a direction parallel to the spooling spindle, and the spindle remains stationary in axial direction. Upon winding, the various wraps or windings should also be pressed against each other so that no space and no looseness will remain which would permit a next superimposed layer to slip between a previously spooled winding. The various windings, then, will be properly spooled, without gaps between each other.

Many spooling devices which require layered windings use operators to guide the material to be spooled in such a way that the windings are placed close to each other. Operating the traverse mchanism of such winding machines requires experience and continuous attention and skill by the operating personnel, since characteristics of the material must be considered when feeding the material to th spooling machine.

It is much more difficult to spool material which is wire-shaped, or tape-shaped, and made of metal or steel, than material which is soft, such as alimentary paste, for example spaghetti, macaroni or the like, or textile fibers or yarns, or filaments.

Spooling apparatus previously used and which do not rely on random winding, but rather on closely adjacently layered windings did not provide good winding results due, in part, to the construction of the particular spooling machines and, in another part, due to lack of skill, or attention of the operators of the machine.

It is an object of the present invention to provide a universal spooling system, apparatus and method which is capable of providing perfect, layer-wound spools of any known material, regardless of its characteristic, and having such size or diameter as is being supplied, and in which the various windings on a layer are closely adjacent; and which is particularly adapted for wire-like or tape-like material having circular or elliptical cross section and in which the windings of a second, superimposed layer fall in the notches formed by the layer underneath.

SUBJECT MATTER OF THE PRESENT INVENTION

Briefly, the traverse (that is, relative axial shift between the spooling body and a material feed guide) is controlled to operate with varying speed. For purposes of explanation, a term will be introduced referred to as the "angle of attitude", which is defined as the angle included by the length of material between the feed guide and the instantaneous position of the material on the spool and a plane tranverse to the spooling axis. This angle is so controlled that, within a predetermined portion of the axial extent of the spool, a predetermined attitude angle is provided, thus pressing adjacent windings of the material against each other. In other axial ranges, however, adjacent the ends of the spool (for example the flanges of a flange spool body), the speed of axial shift is so controlled that the attitude angle $\alpha$ tends to become zero, the traverse speed then again being controlled until the angle of attitude has reached its predetermined value.

According to another, important aspect of the invention, a flange spool is located on a rotating spindle; a traverse apparatus is provided, effecting relative axial shift between a guide or feed element (for example a roller) supplying material to the spool, and the spindle, the traverse apparatus effecting the relative axial shift with changeable speed, the speed depending on the position of the material on the spool and the angle of attitude. Preferably, the guide or feed point is fixed on the frame of the machine and the spindle is relatively axially movable in addition to being rotatable.

The invention will be described by way of example with reference to the accompanying drawings, wherein.

Figure 1:
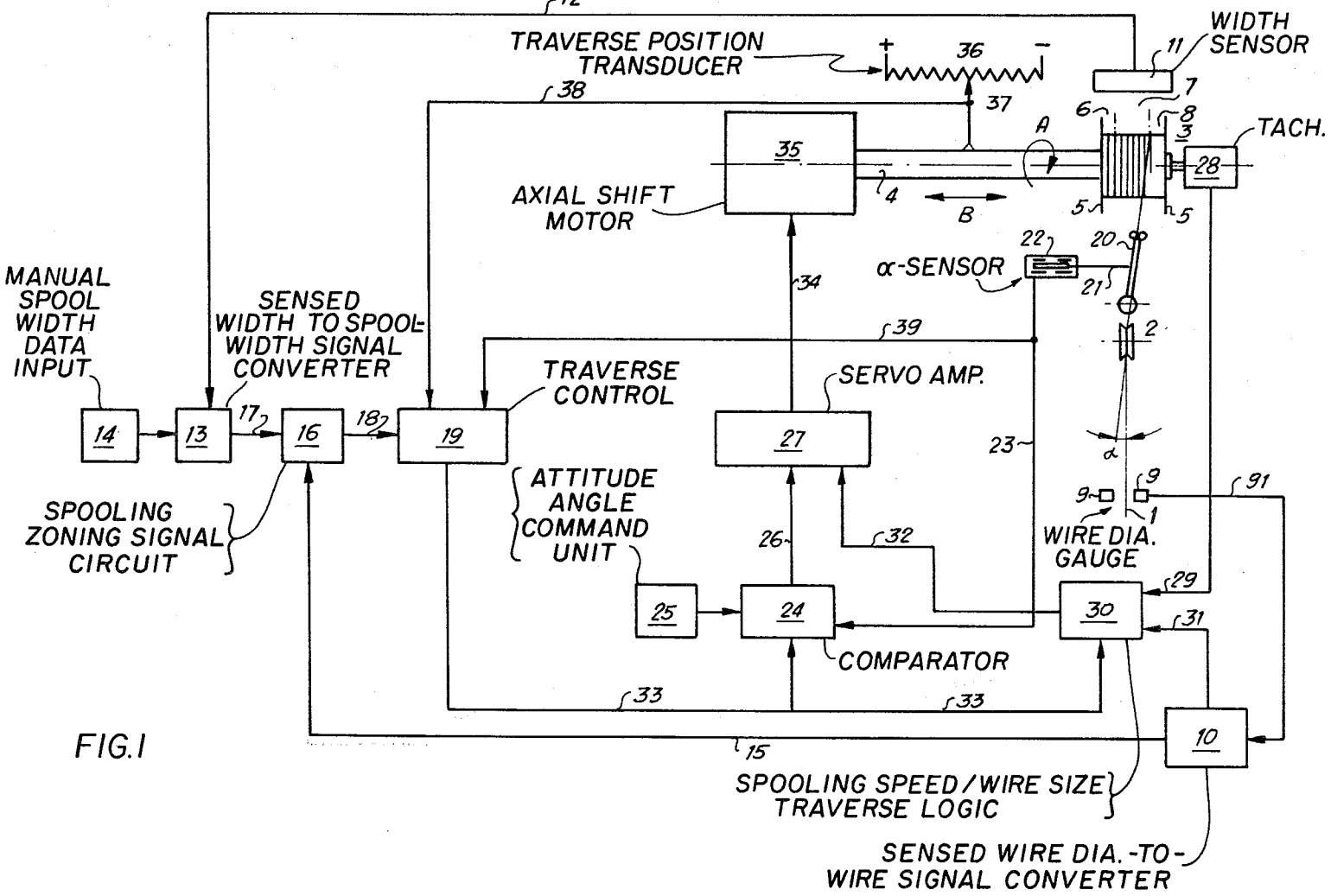
FIG. 1 is a block circuit diagram illustrating an electrical circuit to control layering of the windings on the spooling apparatus.

The apparatus, system and method will be explained in connection with the spooling of wire having circular cross section. A wire 1 (FIGS. 1, 2, 3) is guided over a guide roller 2 on a flanged spooling body 3, to be there wound in multiple superimposed layers, the windings or wraps of each of which are closely adjacent each other. The spooling body or form 3 is rotated, as indicated by arrow A (FIG. 1) about the spindle 4. Spindle 4 is rotated by a motor (not shown in FIG. 1). The spool 3 is flanged, and has two end flanges 5.

Wire 1, shown with circular cross section, is only illustrative; other materials having elliptical, triangular, square, rectangular or other polygonal shape, or tape-like shape, can be spooled. Referring now specifically to FIG. 1: The angle of attitude $\alpha$, as above defined, is shown. This angle $\alpha$ is measured with respect to a plane transverse to the spooling axis of spindle 4 and may also be deemed to be the angle between the material (wire) 1 and the flanges 5 of the spooling body or form 3. Winding of the wire 1 on the body 3 is separated in four phases or time periods. Assuming, first, that the wire 1 is flush with the left flange 5, that is, angle $\alpha$, with the wire against flange 5, is zero. Upon rotation of the spindle 4 in the direction of arrow A, and without traverse, the angle $\alpha$ will increase in the range indicated by the dimension 6. When enough wraps or windings have been placed on the spool so that the wire has reached a distance 6, the angle $\alpha$ will have reached a certain predetermined value, which provides for tight winding of the spools against each other. After the angle $\alpha$ has reached this value, that is, when the attitude angle has reached a desired value, the spool 3 is traversed in axial direction. Traverse of the spool 3 is schematically indicated in FIG. 1 by the double arrow B beneath shaft 4. After the angle $\alpha$ has reached this desired value, the traverse speed of the form or body 3 on the shaft 4 is so adjusted that, considering the speed of winding, diameter of material 1 being fed to the spool, or cross section, respectively, the predetermined desired attitude angle $\alpha$ is maintained at its desired value. This value will reamin throughout the region 7 of the spool body or form 3. Wire 1, therefore, is so wound on the body 3 that the wire wraps continuously progress towards the right-hand flange 5. When a certain distance to the flange 5 is reached, the speed of traverse is changed so that, within the next axial range 8 of the spooling body or form 3, the angle of attitude $\alpha$ of the wire 1 is controlled to reach zero when the last winding of the wire just touches the right-hand flange 5. This speed control is preferably continuous and uniform. The traverse speed of the form or body 3 will reach zero when the wire 1 is at the right-hand flange 5. As a result, the last winding will fit into the wedge-shaped slot between the wire and the flange, formed by the preceding wrap, until the wire will fit above the preceding wrap and thereby forming the first wrap of the next layer, that is, increasing the layer thickness by one. Since wire form or spool 3 continues to rotate, and the traverse speed is still zero, the angle of attitude $\alpha$ now increases in the axial range 8 of the spool, but in opposite direction, until the angle $\alpha$ has reached its desired value. As soon as the desired value is obtained, the spooling body 3 traverses in opposite direction, that is, towards the right of the double arrow B. The spooling process continues throughout the range 7, in which the angle of attitude $\alpha$ is controlled to have the desired value. In the subsequent range 6, the angle of attitude $\alpha$ is then again controlled until it reaches its value of zero and, after the last wrap of the then wound layer has been wound and the first wrap of the next layer is being wound, the angle $\alpha$ is again permitted to reach its desired value. The traverse speed at the end of the winding need not be continuous and smooth.

The system of FIG. 1 describes an apparatus in which the guide wheel or roller 2 is fixed in position on the frame of the machine, and the spooling body 3 moves axially, towards the left, or towards the right, in the direction of the double arrow B. Traverse control can equally be effected by retaining the spooling body 3 in a fixed axial position, and rotating the spooling body with a predetermined speed. The guide roller 2 can be moved relative to the spooling the body towards the left, or to the right, that is, in the direction of the double arrow B as well.

Traverse movement, that is, relative axial shift between the spool 5 and the guide roller 2 must be accurately controlled, keeping in mind the size and characteristics of the material 1, in order to obtain the winding pattern as above described. FIG. 1 illustrates an electrical circuit which controls and supervises this winding sequence. Upon threading of wire 1, the wire is secured to the form body 3, adjacent one of the flanges 5. The diameter of the wire is determined, for example, by measuring or by a size guage 9 (FIG. 1) through which the wire is guided upon first threading of the machine. The size guage 9 supplies an electrical output signal representative of the diameter of the wire 1, or, if other types of material are being fed, of its transverse size. This signal is transmitted over a line 91 to a circuit element 10 which provides an output signal suitable for processing in the system of the present invention, and representative of the wire size.

The size of the body 3 is determined by a width sensor 11, which senses the width between the flanges of the spool form 3, and hence the distance of traverse, that is, the sum the dimensions 6, 7 and 8. Information regarding the width of the flange, from sensor 11, is transmitted over a line 12 to a circuit 13 which converts the output signal from sensor 11 to one suitable for processing in the system. The output from circuit 13 which may be termed a sensed width-to-spool width signal converter is transmitted over line 17 to an $\alpha$-computer 16. The signal applied over line 17 thus is an output signal which is determinative of the position of the flanges 5 and thus defines the traverse distance through which the spooling body or form 3 has to be moved so that the wire 1 is properly spooled thereon. In some instances it will not be necessary to automatically sense the width of the form 5, and a manual spool width data input unit 14 is provided if the width of the spool body, that is, between flanges 5, is not to be obtained from an automatic sensor 11.

A signal representative of the cross section of the wire 1 is transmitted from the converter 10 over line 15 to the $\alpha$ — computer 16. $\alpha$-computer 16 determines when, upon spooling, the attitude angle $\alpha$ should be reduced to the value zero. Computer 16 also determines the limits between the ranges 7 and 8 in one winding direction, and the limits between the ranges 7 and 6 in the other winding direction. This is only possible, however, if the width of the spool is known — which is determined by the width sensor 11 or by manual data from unit 14 and derived from converter 13 and supplied thereto over line 17. The output signal from computer 16 is applied to a traverse control circuit 19 over line 18. Traverse control 19 controls the traverse path in axial direction, that is, in the direction of the double arrow B of relative movement between the guide roller 2 and the spooling body 3.

Operation: Let it be assumed that the medium 1 to be spooled is a wire, guided over guide roller 2 and secured initially to the spooling body 3 at the left flange 5 (FIG. 1), and that the spindle 4 is rotated in direction of the arrow A, so that spooling may begin. As mentioned, the spindle is rotated by a motor (not shown); rotation of the spindle will be discussed in connection with FIGS. 2 and 3, below.

Wire 1 will form wraps around the form body 3. As the wraps lie adjacent each other, within the range 6, the attitude angle $\alpha$ will increase until it reaches a predetermined desired value. The angle $\alpha$ is sensed by a sensing element 20 which, as shown in FIG. 1, is a mechanical sensor formed, as seen for example in FIGS. 2 and 3, by a pair of pins supported on a pivoting arm. Sensing of the angle can also be done by a non-contacting gauge, for example electrooptically, electromagnetically, or capacitatively. When the attitude angle $\alpha$ has reached the edge or limit of the zone or range 6, so that the next lap would fall into the zone or range 7, shaft or spindle 4 is shifted towards the left. The value of the angle $\alpha$ is maintained throughout the entire range 7 at its desired value, as follows:

The position of the sensor 20, that is, the actual value of the attitude angle $\alpha$ is transmitted over a linkage 21 to an $\alpha$-sensor 22 (a mechanical-electrical signal transducer), from where a signal representative of the actual angle $\alpha$ is transmitted over line 23 to a comparator 24. The desired angle $\alpha$, that is, the predetermined angle and forming a command value, is entered into the comparator 24 from command unit 25. This command value is set manually. Comparator 24 compares the command value and the actual value of the angle $\alpha$ as derived from sensor 20–22 and supplied over line 23 and provides an error or comparison signal on line 26 to the servo amplifier 27. The shaft 4 in which the spooling body or form 3 is mounted, is connected to a tachometer 28. The tachometer or tacho generator 28 measures the speed of shaft 4. The measured speed, represented by an electrical signal, is transmitted from tacho generator 24 over line 29 to one input of a spooling speed — wire-size signal processing stage 30. Stage 30 receives a signal from sensed wire diameter to signal converter 10 over line 31, representative of wire size. Stage 30 processes the signals from lines 29 and 31 (speed and wire size) to provide an output signal on line 32 which is representative of lateral shift required, per revolution, to properly control the winding in the ranges 6, 7 and 8. Stage 30 has a further input applied over line 33 and derived from the traverse control 19. The effect on this signal will be described below.

Servo amplifier 27, and receiving the $\alpha$, or attitude angle error signal, as well as the wire winding speed and size and traverse signal on line 32 provides an output at line 34 to an axial shift motor 35. Motor 35 effects axial or lateral shift of the shaft 4 in a respective direction of the double arrow B. The axial shift motor 35 additionally controls the speed of shift, that is, the motor is a variable speed motor.

Reverting again to the operation, as such: When the wire 1 is being wrapped on form 3 in range 7, then control or servo amplifier 27 controls both the direction and speed of the axial traverse feed, by processing the actual attitude angle signal (line 23) and the command unit signal (element 25) as applied in form of an error signal on line 26, which may be modified by the output signal on line 32 which includes data representative of winding speed and size of the wire 1. When the wire is wound on form 3 in the ranges 6 and 8, however, then the signal on line 26, derived from the comparator, is blocked, so that the speed of the axial shift is controlled solely by the output signal derived from stage 30 on line 32.

The signal on line 26, that is, the angle error signal is derived in this manner: to accurately determine the actual, instantaneous axial position to the shaft 4, a feedback system which includes a potentiometer 36 is provided. Potentiometer 36 is supplied from a source of voltage; its tap or slider 37 is mechanically connected to the shaft 4, to be moved upon axial movement of the shaft 4. A line 38 supplies a signal, the value of which is dependent on the axial position of the shaft 4 to the traverse control stage 19. Depending on the position of the shaft 4 with respect to a datum or end position, in its path of movement as indicated by double arrow B, a signal will be derived from the energized potentiometer 36 which forms a d-c signal supplied over line 38. This signal on line 38 need not be an analog signal, as shown; the position feedback system is illustrated purely illustrative since the signal can also be a digital signal, in which case potentiometer 36 will be replaced by a digital position indicator, such as, for example, an electro-optical or electromagnetic pulse disk or strip. The signal on line 38 and the output signal from computer 16, which determines the limit points of the ranges 6, 7 and 8, respectively, are provided to the traverse control stage 19. The signal representing the actual value of the attitude angle $\alpha$ is also supplied to the traverse control 19 over a branch line 39. Stage 19 processes the two signals on line 38 (actual traverse position of the shaft 4) and the signal on line 19 (actual attitude angle) and provides an output which, then, will be representative of the actual, instantaneous position of the wire 1 being applied to the spool 3. When the value of the two signals in the lines 38, 39 corresponds to the value of the signal on line 18 (which defines the limits between the range 6, 7 and 7, 8, respectively), then line 33 is energized to disconnect the comparator 24 and, rather, actuate the spooling speed-wire-size stage 30. The signal from line 26 will then be blocked and the servo amplifier 27 will then process only the signal applied on line 32 from stage 30 to control the axial shift motor 35 accordingly, and hence the axial shift of shaft 4 and of the spool form 3. Thus, when the wire is being wound in the ranges 6 and 8, the output from stage 30, alone, will control the servo amplifier 27.

Winding layers are, in this manner, placed over each other until the spooling form 3 is completely full with wire 1. The entire control system is then disconnected by a suitable supervisory controller sensing, for example, weight of the spool or outer diameter.

Spooling is controlled by controlling the attitude angle $\alpha$ in the axial range or zone 7 of the spool, and controlling the axial speed of longitudinal shift in the two ranges 6, 8. In the ranges 6 and 8, depending on the direction, the value of the attitude angle $\alpha$ is reduced from its nominal or commanded value to zero, and then is permitted to increase from zero until it reaches the commanded value.

Figure 2:
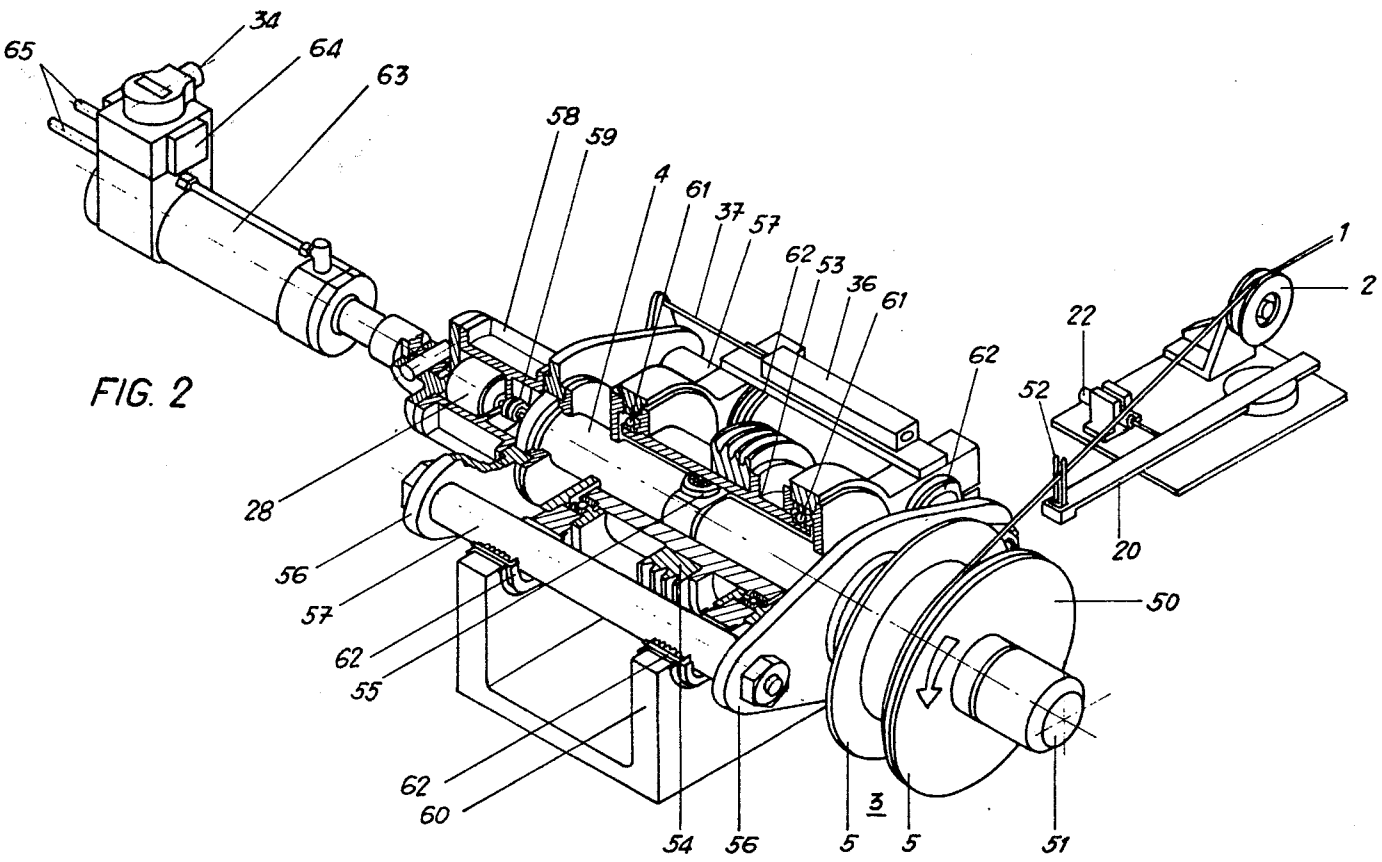
FIG. 2 is a schematic, perspective view of the spooling machine, partly in section.

Referring to FIG. 2 which shows the structure of a spooling machine: A flanged spool form 3 is applied to the shaft 4, and secured thereon by means of a flange cap 50 held by an attachment screw or chuck 51. Wire 1 is guided over roller 2, between guide pins 52 secured to measuring arm 20 on the spool, and initially attached to one of the flanges 5 of the spool 3. Shaft 4 is axially movable in the hollow shaft 53. Hollow shaft 53 is driven from a multiple pulley 54, engaged with multiple V-belts and driven from a motor (not shown). Rotation of the hollow shaft 53 is transferred to shaft 4 by means of follower 55, formed as an axially slidable ball bearing, engaged in a groove in the hollow shaft 53. Rotation is thus transmitted from pulley 54 and over hollow shaft 53 to shaft or spindle 4, to provide for spooling of wire 1 on the form 3, while permitting axial shift of the spindle 4 in the direction of the double arrow B. Spindle or shaft 4 is journalled in bearing end plates 56. The end plates 56 are connected by guide rods 57 which, in turn, are axially movable in bearings 62. The bearing plate 56, shown on the left side of FIG. 2, is formed with a housing 58 in which the tacho generator 28 is located, connected to the spindle 4 by means of a coupling 59. Housing 58 is fixedly secured to the end plate 56. The axial shift of the spindle 4 is determined by potentiometer 36, the tap or slider 37 of which is also connected to the left end bearing plate 56. Hollow shaft 53 is jounalled in bearings 61 which, in turn, are supported on the carrier or support 60. The axial shifting arrangement, including the two bearing end plates 56 and the guide rods 57, is axially movable on the carrier 60 and guided for axial movement by ball bearing 62. The guide pulley 2 is secured to the frame of the machine to which the carrier 60 is likewise secured. The frame has been omitted from the drawing for clarity. Wire 1 is spooled on the form 3 by rotating the form 3 in direction of the arrow. Axial shift of the shifting arrangement 56, 57 is effected by the traverse motor 35 (FIG. 1) which, in the embodiment of FIG. 2, comprises a hydraulic cylinder 63 and a piston. The piston is movable in cylinder 63; its projecting end is securely connected by means of a coupling to the housing 58. The entire axial shifting arrangement 56, 57, and with it shaft 4 and form or spool 3, are moved axially in the direction of the double arrow B upon movement of the piston in the cylinder 63. A servo valve 64 controls hydraulic movement of the piston, and thus controls axial shift. The servo valve 64 is controlled from servo amplifier 27 (FIG. 1) over electrical control lines 34. Hydraulic pressure fluid to operate the electro-hydraulic servo is supplied over supply and drain lines 65.

Figure 3:
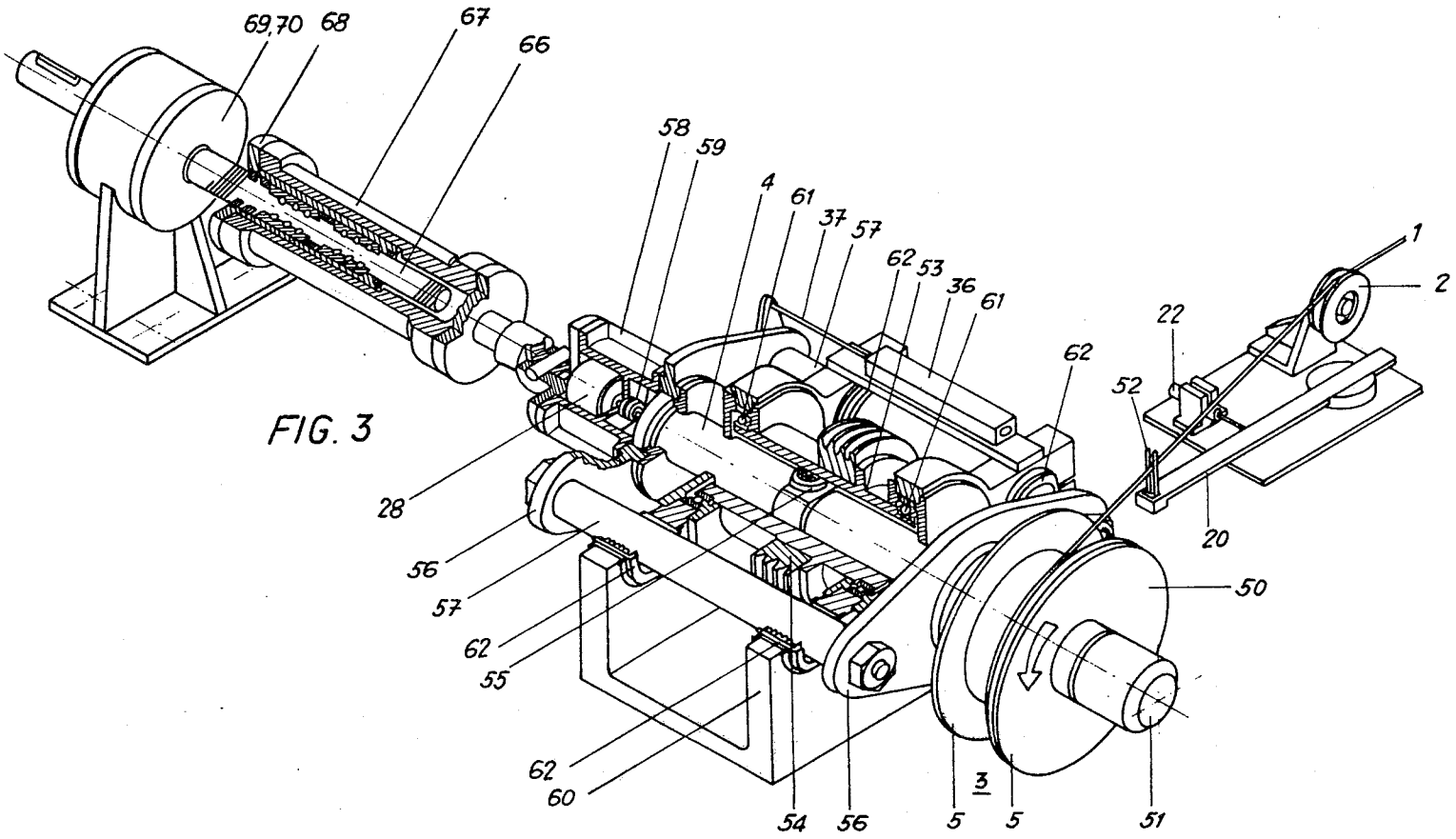
FIG. 3 is a view similar to FIG. 2 and illustrating another embodiment of a spooling machine.

The structure of FIG. 3 is, basically, similar to that of FIG. 2, and similar parts have been given the same reference numerals and will not be described again. The difference between the embodiment of FIGS. 2 and 3 is the mode of effecting axial shift. A flanged tube 67 is connected to housing 58 which — as above described — is secured to the left bearing end shield 56, and hence to the entire shift arrangement 56, 57. A threaded spindle, having its threads in the form of ball races 66, is located in the flanged tube 67. A flange carrier 68 which forms a bearing for the spindle 66 is connected to a rotary motor. The rotary motor may be either an electric motor 69 or a hydraulic motor 70. Motor 69, or 70, respectively, rotates spindle 66 so that cams or matching balls which engage the thread of the spindle will effect movement of the flanged tube 67 in the one or other direction, depending on the direction of rotation of the respective motor, and hence axially move the shift arrangement 56, 57. The flanged tube 67 is secured to housing 58 over a coupling. If the rotary motor is an electric motor 69, then it is preferably constructed as an axial air gap, or pancake-type motor. The control amplifier 27 of FIG. 1 can directly control an electric motor 69, or can control a hydraulic motor 70 by means of an electro-hydraulic converter over line 34, in such a manner that the axial shift arrangement 56, 57, and with it shaft 4 and form or spool 3, are shifted axially in the one or other direction of the double arrow B. The hydraulic connections to a hydraulic motor 70, or electrical connections to an electric motor 69 have been omitted from the drawing for clarity.

The axial shift arrangement, illustrated in FIGS. 2 and 3 as being applied to the shaft or spindle of the spool, may be applied to the guide roller 2, instead. What is important is to obtain relative axial movement between the guide roller 2 and the spool 3. This relative movement may be obtained by axially shifting the guide roler 2 with respect to the spool 3. The spindle 4 can then be directly driven from the pulley 54, and the axial shift motor 35 (FIG. 1), 63 (FIG. 2), 69, 70 (FIG. 3), with the respective axial movement effecting elements would have to be connected to the support for the guide roller 2. The angle sensor 20 would remain as shown, and will carry out the axial movement parallel to the axis of the spool 3 as well.

Various changes and modifications may be made within the scope of the inventive concept.

The various stages and elements described in connection with FIG. 1 are simple and well known devices. The manual spool width data input, if in analog form, may be no more than a potentiometer, connected across a source of reference voltage, similar to potentiometer 36. The tap point of potentiometer forming the data input 14, and setting a certain voltage, would then provide a signal representative of width of the spool, just as the setting of the slider 37 on potentiometer 36 provides a signal representative of the position of the spool. The input may, of course, also be in digital form, and the entire system can operate based on digital data if suitable analog/digital converters are included. Element 11, if of the non-contacting type, can be a light gauge, in which a plurality of light-sensitive sensors are located side-by-side, the sensor which is shaded by the flanges providing a negative output signal which is evaluated to provide an output representative of the width of the spool. The $\alpha$ — computer 16 can be formed as a multiplier and dual comparator; the width of the wire, as sensed by guage 9 and transmitted as an electrical signal from stage 10, is multiplied by the number of turns required to accumulate the ranges 6, and 8, respectively, and the so multiplied values are compared with the width signal derived in line 17; when the first comparison (assuming a start from the left) is reached, the limit of zone or range 6 is determined. Subtracting the multiplied number of turns corresponding to the range 8 from the entire width determines the other limit. The traverse control 19 likewise can be a logically connected comparator comparing actual position (line 38) of the spindle 4 with position signals derived from stage 16 and, hence, actual angle (derived on line 39 from attitude angle sensor 22) with the angle of attitude of the wire when at the flanges 5, or at the limits of the ranges 6, 8, respectively, which can be determined by measuring the known distance from the guide roller 2 to the engagement point of the wire 1 with the spool 3 by simple trigonometry. Gauge 9 need not be a running, non-contacting gauge but, rather, a value corresponding to the thickness of the material being wound can be entered in element 10 which, then, may be similar to the data input element 14, representing spool width data. The motion-signal transducer 22 may be of the Schaevitz-type, providing an analog output signal or may be a digital position-signal transducer, or also a potentiometer, similar to potentiometer 36, 37. All the other elements and stages shown in the diagram are standard articles of servo control systems.

The stage 30 can be a simple analog (or digital) computation circuit which computes, from the two inputs (speed of winding and wire size) a signal which is representative of the required traverse speed to bring wire 1 from the limit position of an end zone 6 or 8 to the end flange 5, considering the speed of rotation. Thus, from the known data of the thickness of the wire, which determines the number of windings in zone 8, and the speed of winding, the traverse speed can readily be computed, and a signal representative thereof supplied to the servo amplifier 27 which, then, will control the axial shift motor 35 to operate at that predetermined speed, thus bringing the angle from the predetermined, servo controlled angle in zone 7 to null or zero. At that point, the axial shift motor can stop until the wire, being pulled laterally by the adjacent windings, has deflected the arm 20 to such an extent that the sensor 20–22 provides a signal that the angle $\alpha$ has been reached so that, over line 39, the traverse control 19 will open the circuit from comparator 24 so that servo amplifier 27 will be controlled from line 26, rather than from line 32, which is then disabled. Alternatively, the winding of the wire itself can be sensed, or the speed of winding, and information regarding the winding size, as fed into stage 30, for example, can be utilized to determine the instant of time when enough wire has been spooled on the spool, so that the limit of the end zone is again reached, and providing a signal which disables the output on line 32, so that the output from comparator 24 on line 26 can take over control of the servo amplifier. The relative energization, and de-energization, that is, application of signals to servo amplifier 27 is controlled from the traverse control 19 over line 33, which is indicated in a singleline diagram although comparator 24, and stage 30 will, in actual operation, be connected to the servo amplifier 27 in alternate cycles, with a dead band after operation of the axial shift motor under control of stage 30, that is, upon formation of the subsequent layer of winding, and hence reversal of direction of the attitude angle.

We claim:

1. Controlled spooling machine system for layer windings of elongated materials (1) having circular, elliptical, or polygonal cross section, on a rotating spool (3) having a predetermined axial extent, comprising winding speed sensing means (28) sensing the speed of the spool and deriving a winding speed signal (29) representative of speed of rotation of the spool;

means (9) providing a material size signal (91) representative of the width of the material;

a guide means (2) guiding the material towards the spool so that the material will define an angle of attitude ($\alpha$) with respect to a plane transverse to the axis of rotation of the spool;

means (20, 21, 22) sensing the attitude angle ($\alpha$) of the material as it is supplied to the spool, at any instant, and providing an attitude signal (23, 39);

traverse means (35, 64, 69, 70) effecting relative axial traverse movement between the spool (3) and the guide means (2) to effect progressive adjacent winding of the material on the spool and the formation of superimposed layers between the axial limits of the spool, and traverse control means (19, 24) controlling said traverse means (35) and having said winding speed signal, said material size signal (91) and said attitude signal applied thereto and providing a command output signal to said traverse means (35) to command the relative position between said guide means (2) and the instantaneous axial position of the spool (3) such that the material, as it is wound on the spool, is pressed against the next previously applied winding on the spool, by controlling the attitude angle ($\alpha$) of the material with respect to the spool, as the material is wound on the spool, to reach a predetermined value, and to change the speed of the relative traverse movement in predetermined axial ranges (6, 8) of material placement on the spool, and occurring just before, and after the formation of superimposed windings adjacent the axial ends of the spool such that the attitude angle ($\alpha$) will tend to become zero as the wire is wound on the spool and approaches an axial end thereof, and, then after formation of a new winding layer, the attitude angle is again controlled to reach said predetermined value.

2. System according to claim 1, wherein the traverse control means includes logic stages (24, 30) having said attitude angle signal applied thereto and further being responsive to said winding speed signal (29) and said material size signal (91) to control the relative axial movement between the guide means (2) and the spool (3) as a function of winding of material (1) on the spool, while the spool is rotating at a speed sensed by said winding speed signal, said logic stages controlling said traverse means (35) so that the attitude angle ($\alpha$), within a predetermined width range (7) intermediate the terminal width ranges (6, 8) of the spool, will have a predetermined, desired value, and such that in the terminal ranges (6, 8) of winding of the material (1) on the spool (3), the attitude angle is changeable between said desired value and zero.

3. System according to claim 2, wherein the attitude angle sensing means comprises a sensor (20, 52) located in sensing relation to the material (1) and providing a signal representative of the actual attitude signal;

a command signal source (25) providing a signal representative of said predetermined attitude angle ($\alpha$);

and a comparator (25) comparing the actual attitude angle value and said command angle value, and providing an error output signal (26), said comparator forming at least in part said traverse control means, the error output signal being applied to said traverse means (35) to effect said relative traverse shift, between the guide means (2) and the spool (3).

4. System according to claim 2, further comprising a logic stage (30) combining the material size signal (91) and the winding speed signal (29) and providing an output signal having a parameter representing traverse speed required to place adjacent windings of the material, having the size as determined by said size signal (91), and being spooled at a speed as determined by said winding speed signal (29), said output signal being applied to the traverse means (35) to command the traverse means to effect said traverse movement.

5. System according to claim 4, wherein the traverse control means comprises a command unit (25) providing a signal representative of a commanded, desired attitude angle ($\alpha$);

a comparator (24) having said command signal and said attitude angle signal (23) applied thereto and providing an error signal representative of deviation of the actual attitude angle of the material, as it is being spooled, from said desired angle;

and wherein the traverse control means further comprises a servo amplifier (27), said servo amplifier having both said error signal (26) and said logic output winding signal (32) applied thereto, said servo amplifier providing an output to said traverse means (35) to hold said attitude angle at said predetermined value when wire is being wound on said spool in a range (7) intermediate said predetermined axial end ranges (6, 8).

6. System according to claim 5, wherein the traverse control means further includes means determining the actual instantaneous position of the material (1) on the spool (3) and comparing said position with respect to the limits of said predetermined axial end ranges (6, 8);

said position determining means being connected to (33) said servo amplifier (27) to disable control of said servo amplifier by said attitude angle error signal if the actual instantaneous position of the material is in a respective predetermined axial end range (6, 8).

7. System according to claim 4, wherein said logic wire speed and wire size stage (30) is connected to said traverse means (35) and provides a signal thereto which controls the traverse means to change the attitude angle between zero and said predetermined angle ($\alpha$) when the instantaneous position of the wire is in a respective one of said predetermined end ranges (6, 8).

8. System according to claim 2, wherein the traverse control means comprises means (11, 14, 13) providing a signal (17) representative of actual width of the spool (3);

computer means having said spool-width signal (17) applied thereto and receiving, further, the signal (91, 15) representative of the material size, and providing output signals representative of the limits of said predetermined axial end ranges (6, 8) with respect to the total axial width of the spool (3);

position sensing means (36, 37) coupled to said traverse means (35) and providing an actual position signal of the respective axial position, with respect to the width of the spool, of said guide means and the spool;

and wherein the traverse control means further comprises a traverse control stage (19) having said limit signals, said actual traverse position signal, and said predetermined axial end range signals applied thereto to provide said command output signals to said traverse means.

9. System according to claim 8, wherein said traverse control stage further has said attitude angle signal ($\alpha$) applied thereto, and said traverse means comprises a servo system including a servo amplifier (27) and a motor (35) controlling respective traverse movement;

said servo amplifier having applied thereto an error signal (26) representative of deviation of the actual attitude angle from a commanded value, and a spooling speed/material size signal representative of traverse speed required to spool, at said spooling speed, said material to cover a predetermined axial extent;

said servo amplifier being controlled by said traverse control stage to selectively effect traverse by said traverse means (35) under command of said error signal when the material being spooled is in an intermediate axial range (7) which falls between said predetermined axial end ranges (6, 8), and said servo amplifier (27) controlling said traverse means (35), selectively, under command of said spooling speed/material size signal (32) when the material being spooled is in an end range after having been spooled at an intermediate range, to traverse at a rate such that the attitude angle will be zero when the material is flush with the terminal limit of the spool.

10. System according to claim 1, wherein the traverse means (35) comprises a frame (60), a rotatable spindle (4), and a traverse cage (56, 57) journalled (62) in the housing for sliding movement parallel to the axis of rotation of the spindle, and means (54) imparting rotation to the spindle;

and wherein the guide means (2) are located at a fixed position on the frame, with respect to the axial position of the spindle.

11. System according to claim 1, wherein the attitude angle sensing means (20) includes a guide arm (20) and guide means (52) between which said material is being guided, said attitude angle sensing means being located between the guide means (2) and the spool.

12. Controlled spooling machine for layered winding of elongated material (1) on a rotating spool (3) having a predetermined axial extent, comprising a rotatable spindle (4), said spool (3) being mounted on the spindle;

means (2) guiding the material (1) towards the spool so that the material will define an angle of attitude ($\alpha$) with respect to a plane transverse to the axis of rotation of the spool (3);

variable speed traverse means (35, 63, 64; 67, 69, 70) effecting relative change of position between said guide means (2) and the axial position of the spool (3);

and means controlling the speed of said relative change of position in dependence on a. instantaneous axial position of the material (1) on the spool (3), and b. instantaneous angle of attitude ($\alpha$) of the material being supplied to the spool, said control means comprising an electrical circuit including:

attitude angle control means (20–27, 34, 35) controlling the attitude angle to a predetermined desired value; and traverse speed control means (28, 29, 9, 91, 10, 31, 32, 27, 34, 35) controlling the speed of relative axial traverse movement between said guide means (2) and said spool (3), so that the attitude angle ($\alpha$) is variable between a value of zero and its desired value.

13. Controlled spooling machine according to claim 12, wherein the spindle (4) is axially shiftable and the variable speed traverse means is connected to and controls the actual shift of the spindle with respect to the guide means (2).

14. Machine according to claim 13, wherein the machine comprises a frame, and the guide means is fixed to the frame.

15. Machine according to claim 12, wherein a hollow shaft (53) is provided, the spindle (4) being located in the hollow shaft;

drive means (54) secured in rotation transmitting connection to said hollow shaft;

and means (55) rotationally connecting the spindle (4) and the hollow shaft.

16. Machine according to claim 12, further comprising a slidable cage (56, 57), said cage being movable and connected to said traverse means, the spindle (4) being journalled in said cage.

17. Machine according to claim 12, wherein said traverse means comprises a hydraulic cylinder-piston system (63) connected to axially shift said spindle.

18. Machine according to claim 12, wherein said traverse means comprises a rotatable motor including at least one of: an electric motor (69) and a hydraulic motor (70), said at least one motor being connected to a threaded spindle (66), and a non-rotatable engagement element (67) connected to said rotating spindle (4) and engaging said threaded spindle.

19. Machine according to claim 12, further comprising a tachometer (28) and providing a measurable output representative of the speed of rotation of said spool (3) on said spindle.

20. Machine according to claim 12, wherein the attitude angle control means comprises a support frame (60) and measuring means (36, 37) secured to said support frame and to said traverse means and providing an output signal representative of relative change in position between said guide means and the axial position of the spool.

21. Machine according to claim 12, wherein the attitude angle control means comprises attitude angle sensing means responsive to the attitude angle of said material (1) as it is being spooled on said spool (3), said attitude angle sensing means (20, 22, 52) being located intermediate said guide means (2) and said spindle (4).

22. Machine according to claim 21, wherein said attitude angle sensing means comprises means (52) in sensing engagement with said material (1), said sensing engagement means including at least one of: mechanical means; optical means; magnetic means; and capacitative means, in sensing relation with said material.

23. Machine according to claim 12, further comprising a limit sensor (11) located in sensing relationship to the spool (3) and sensing the axial width, and hence the spooling limit of said spool.

24. Machine according to claim 12, wherein the means controlling the speed of relative change of position of the traverse means, additionally comprises means (11, 12, 13, 14, 16, 17, 18, 36, 37, 38, 19, 33) controlling said distance signal control attitude angle control means and traverse speed control means in dependence on winding of the material (1) on the spool (3) to control the attitude angle ($\alpha$) to have said predetermined value within a predetermined intermediate axial range (7) of the spool and to have a value between said predetermined angle ($\alpha$) and zero upon winding of said material on the spool in predetermined axial end ranges (6, 8) located at either side of and adjacent said intermediate range (7) and being wound just before, and after formation of superimposed layers of winding.

25. Machine according to claim 24, wherein said distance signal control means comprises means (11, 14) providing an output signal representative of the axial limit of said spool;

signal generator means (16) providing at least two output signals determining the limits said end axial ranges (6, 8) of the spool (3) and said intermediate range (7);

axial traverse position sensing means (36, 37) coupled to said guide means and the spindle and providing an output signal representative of actual axial relative position between said guide means and the spool (3) on the spindle (4);

circuit means (19) connected to and controlled by said position signal generator circuit (16), the actual axial relative position signal derived from said position sensor (36, 37), and a signal representative of actual attitude angle;

and a servo amplifier (27) connected to said circuit (19) and controlling the variable speed traverse means, said variable speed traverse means being controlled so that the attitude angle will have its predetermined desired value when the material is spooled within said intermediate range (7) and said attitude angle is controlled to have a value different from said predetermined attitude angle, to a value of zero, or from a value of zero to said predetermined value, when the material being spooled is in said end ranges.

26. Machine according to claim 25, wherein the attitude angle control means comprises actual attitude angle sensing means (20, 21, 22);

and wherein said position signal determining circuit (19) is effective to disable application of said angle attitude signal to the servo amplifier (27) when the material (1) being spooled on the spool (3) is outside said intermediate range (7) to provide for override control of the variable speed traverse means by the signal from said logic circuit (30).

27. Machine according to claim 12, wherein said attitude angle control means comprises attitude angle sensing means (20, 21, 22) providing an output signal representative of actual attitude angle of the material as it is being spooled on the spool (3);

means providing a signal representative of said predetermined desired attitude angle;

a comparator (24) having said actual and said command attitude angle signals applied thereto and providing an error output signal;

and a servo amplifier (27) connected to and controlled by said error signal and controlling said variable speed traverse means to effect said relative change of position.

28. Machine according to claim 12, wherein said traverse speed control means comprises a tachometer (28) providing an output signal representative of the speed of the spool (3);

means (9, 91) providing an output signal representative of the size of the material (1) to be wound on the spool;

a logic circuit stage, connected to and receiving electrical signals representative of the winding speed and the material size;

and a servo amplifier (27) connected to said traverse means, the output signal of said logic stage being connected to said servo amplifier and providing a signal representative of the traverse speed of operation of said traverse means to effect closely layered winding of said material on said spool.

29. In a method to wind elongated material on a wind-up spool, in which the wind-up spool (3) is rotated, said material is guided to the spool by a guide means (2), and the spool (3) and the guide means (2) are moved axially relative to each other to provide for traverse of the material being wound on the spool, the material defining, with respect to a plane transverse to the spooling axis, an attitude angle ($\alpha$), the steps comprising a. sensing the speed of rotation of the spool and deriving a winding speed signal;

b. sensing the width of the material being wound on the spool and deriving a material size signal;

c. sensing the attitude angle of the material being wound on the spool and deriving an attitude signal;

d. sensing when the material being wound on the spool has reached an axial extent thereon corresponding to the limit of a first end range (6) and deriving a distance signal; and e. controlling the traverse speed under control of said speed signal, said size signal, said attitude signal, and said distance to provide for e. 1. a controlled attitude angle of winding when the material is adjacent an axial limit of the spool to be an angle of about zero, and continuing winding to cause said angle to increase by adjacent wrapping of said material;

e. 2. a controlled attitude angle of a predetermined value when, as determined by said attitude angle signal, the material has reached an intermediate winding range (7) extending axially of said spool, and during winding throughout said intermediate range;

e. 3. a decreasing attitude angle when the material is being wound at the second end range (8) of the spool to decrease from said predetermined angle to an angle of about zero;

e. 4. said winding to form a second layer, said angle continuing to be zero and permitting building up of adjacently located windings until the attitude angle, in the reverse direction, again reaches said predetermined value; and repeating steps (e)-2, (e)-3, and (e)-4.

30. Method according to claim 29, wherein the step of controlling the traverse speed comprises controlling the speed of relative axial shifting of the guide means (2) and the spool (3) to be essentially constant when the material is wound on the spool in said intermediate range (7) and increasing the speed of traverse thereafter while carrying out step (e)-3, and then during step (e)-1, retaining the relative position of the guide means (2) and the spool (3) fixed until the material has said predetermined attitude angle.

31. Method according to claim 29, wherein the step of controlling traverse movement speed comprises:

controlling the traverse movement during step (e)-1 to have a speed of essentially zero, resulting in no traverse movement until the angle signal has reached a level indicative that the material wound on the spool has an axial extent corresponding to the limit of a first end range (6);

controlling the traverse movement to have a speed commanded by said attitude signal, the spool speed signal, and the size signal during step (e)-2;

and controlling the traverse movement during step (e)-3 under command of the distance signal, the speed signal, and the size signal.

* * * * *